US010689147B2

(12) United States Patent
Nikolic

(10) Patent No.: US 10,689,147 B2
(45) Date of Patent: Jun. 23, 2020

(54) SELF FOLDING POLYGONAL IMPERMEABLE FOOD BOX AND A TOOL FOR ITS FORMING

(71) Applicant: Ivan Nikolic, Belgrade (RS)

(72) Inventor: Ivan Nikolic, Belgrade (RS)

(73) Assignee: Ivan Nikolic, Belgrade (RS)

( * ) Notice: Subject to any disclaimer, the term of this patent is extended or adjusted under 35 U.S.C. 154(b) by 160 days.

(21) Appl. No.: 15/808,058

(22) Filed: Nov. 9, 2017

(65) Prior Publication Data

US 2018/0086495 A1 Mar. 29, 2018

Related U.S. Application Data

(63) Continuation of application No. PCT/RS2016/000007, filed on Apr. 6, 2016.

(51) Int. Cl.

| | |
|---|---|
| ***B65D 5/20*** | (2006.01) |
| ***B65D 5/42*** | (2006.01) |
| ***B65D 5/24*** | (2006.01) |
| ***B65D 5/36*** | (2006.01) |
| ***B65D 5/40*** | (2006.01) |
| ***B65D 5/56*** | (2006.01) |
| ***B65D 81/34*** | (2006.01) |
| ***B65D 85/72*** | (2006.01) |
| *B65D 5/68* | (2006.01) |

(52) U.S. Cl.

CPC ..... *B65D 5/2033* (2013.01); *B65D 5/24* (2013.01); *B65D 5/241* (2013.01); *B65D 5/3657* (2013.01); *B65D 5/40* (2013.01); *B65D 5/4204* (2013.01); *B65D 5/4266* (2013.01); *B65D 5/563* (2013.01); *B65D 81/3453* (2013.01); *B65D 85/72* (2013.01); *B65D 5/68* (2013.01)

(58) Field of Classification Search

CPC ..... B65D 5/2033; B65D 5/24; B65D 5/3657; B65D 5/40; B65D 5/56; B65D 5/563; B65D 5/64; B65D 5/4204; B65D 85/72

See application file for complete search history.

(56) References Cited

U.S. PATENT DOCUMENTS 2,003,326 A * 6/1935 Wellman ..... B65D 5/12 229/109

2,483,063 A 9/1949 Ray (Continued)

FOREIGN PATENT DOCUMENTS

DE 202010001585 U1 7/2011

EP 1234774 A1 8/2002

(Continued)

*Primary Examiner* — Justin M Larson

(74) *Attorney, Agent, or Firm* — The Watson IP Group, PLC; Jovan N. Jovanovic

(57) ABSTRACT

A self folding polygonal impermeable food box and a tool for its forming. The box is made from cardboard coated on its inside with PET film or foil. The box has a bottom, six lateral sides, two lateral sides and eight corner sides which are partially transparent and directed towards the inside of the box. The box is covered by a cover so that the sides of the cover rest on the outer surfaces of the lateral sides and seal the box. There is also a second variant of the box. The tool for forming the box, which is preferably made from stainless steel, has a bottom, six guides and two guides, which form the six lateral sides and the two lateral sides of the box.

5 Claims, 9 Drawing Sheets

(56) References Cited

U.S. PATENT DOCUMENTS

| | | | | |
|---|---|---|---|---|
| 3,966,112 | A | 6/1976 | Gordon | |
| 4,079,853 | A * | 3/1978 | Casutt | B65D 5/0005 229/101 |
| 4,489,112 | A | 12/1984 | Wise et al. | |
| 4,493,574 | A | 1/1985 | Redmond | |
| 4,589,591 | A * | 5/1986 | Sjostrand | B29C 65/3656 229/198.2 |
| 5,000,374 | A * | 3/1991 | Deiger | B65D 5/2033 229/103.11 |
| 5,156,330 | A | 10/1992 | Rosen | |
| 5,253,801 | A | 10/1993 | Bernstein et al. | |
| 5,351,879 | A * | 10/1994 | Liu | B65D 5/2033 229/104 |
| 5,397,051 | A * | 3/1995 | Liu | B65D 5/2033 229/109 |
| 6,359,272 | B1 * | 3/2002 | Sadek | B65D 5/2033 219/730 |
| 7,870,995 | B1 * | 1/2011 | Kaltman | B65D 5/2047 206/485 |
| 8,186,570 | B2 * | 5/2012 | Learn | B65D 5/2033 229/117.12 |
| 9,718,576 | B2 * | 8/2017 | Moore | B65D 5/243 |
| 2002/0113116 | A1 * | 8/2002 | Vayrette | B65D 5/563 229/5.84 |
| 2005/0241980 | A1 * | 11/2005 | Schmitt | B65D 5/2019 206/524.1 |
| 2010/0102111 | A1 | 4/2010 | Learn | |
| 2012/0228371 | A1 * | 9/2012 | Jang | B65D 5/2028 229/199 |
| 2018/0065772 | A1 * | 3/2018 | Nikolic | B65D 21/0212 |
| 2018/0086495 | A1 * | 3/2018 | Nikolic | B65D 5/2033 |

FOREIGN PATENT DOCUMENTS

| | | | |
|---|---|---|---|
| EP | 1636118 | B1 | 10/2006 |
| EP | 2797815 | B1 | 4/2016 |
| GB | 2324519 | A | 10/1998 |
| GB | 2435880 | A | 9/2007 |
| WO | 2012019084 | A1 | 2/2012 |

* cited by examiner

SELF FOLDING POLYGONAL IMPERMEABLE FOOD BOX AND A TOOL FOR ITS FORMING

CROSS-REFERENCE TO RELATED APPLICATION

This application is a continuation of PCT/RS2016/000007 entitled "A Self Floding Polygonal Impermeable Food Box and A Tool for Its Forming" filed Apr. 6, 2016, which claims the benefit of patent application No. P 2015/0322 which was filed on May 12, 2015 in The Republic of Serbia, the entire specification of both of which is hereby incorporated by reference in its entirety.

BACKGROUND

Field of Technology

A self-folding polygonal impermeable food box and a tool for its forming, according to the invention, belongs to the packaging of the polygonal cross-section, e.g. to boxes formed by folding or erecting one or more blanks made of paper preparations by folding all the parts connected to the central panel to form a body of packaging in the form of shallow vessels specially constructed to allow collapsing and re-erecting without disengagement of side or bottom connections, where adjacent sides are interconnected by gusset folds, as well as elements of packaging that can be folded or errected more accurately by its inner linings or layouts. The food box according to the invention, also includes packaging for the transport and packaging of foods to be cooked or heated in the packaging, where the boxes are specially constructed to contain liquids.

Technical Problem

Technical problem relates to the construction of transport package for ready-to-eat meals, salads, fried and fatty products, products being consumed with use of sauces or dressings; an impermeable package which maintains its shape also when hot foodstuffs has been packaged therein; a package printable on its outer side, while its inner side still complies with demands relating to food packaging from standpoint of health and microbiological safety; a package that can be transported in sheets and can be easily formed on the packaging site, thus influencing on the low price of transport; a package which, if necessary, can be disinfected by means whose application is approved for use with food; a package whose price is competitive in comparison with existing cardboard and PET packages, wherein its internal side completely complies with aesthetic appearance that does not reveal a structure of cardboard used for forming the package, and also complies with protective, storage—transportation use and ecological functions and it complies with the standards and regulations relating to the appropriate field of technology.

State of the Art

It is generally accepted that packaging material is an important element in creation of appearance of packages and it practically determines a choice of manufacturing technology therefor. These facts have influenced the development both of polymeric materials and cardboard packages which in combination therewith enables safer packaging in light cardboard boxes made of special cardboards coated with polymeric films resistant to heat, humidity etc.

In industrial production with high productivity rate any process comprising involvement of manual work in packaging slows down production process on the whole, which becomes more expensive due to slower packaging. Demands in terms of precision of the packages are set very high, and a volume enclosed by polymeric packages is much bigger, thus influencing both transportation and storage expenditures, especially if the packages are filled in smaller points of sale all over territory covered by the foodstuffs manufacturer. The polymeric packages exposed to high temperatures caused by hot foodstuffs packed therein are prone to deformation due to elevated temperature, thus causing deteriorate effects either on the appearance of the package or increase in its price, because increasing the thickness of applied material is necessary to decrease effect of heating.

In that sense this invention is transported in sheets; it can be branded; it is formed manually easily by using the tool; it is impermeable; it maintains its shape in spite of packing hot foodstuffs therein or warming foodstuffs up packed in the box and it does not open during transportation except in a case of strong deformation caused by a blow, the shape of its base is eight-sided, it has transparent PET material between the lateral sides and during its opening an semi-deep dish is formed from its bottom. By means of the tool both the bottom and the cover for the box form fast and the invention as such has not existed until now.

From patent documentation are known certain solutions differing as such from the solution of the subject invention.

In U.S. Pat. No. 4,493,574 issue dto Redmond, a dispenser package for flowable substances is disclosed that appears to include a flexible part-protrusion, therein is placed liquid product and relatively stiff material rests on the mentioned part, wherein this package is opened either along fault line or cut pattern scored in relatively stiff material with one hand in such way that the package is pressed in "V"-like shape towards dimple, which is also formed in pyramidal shape. Both pressure and force concentrate on the formed protrusion, thus enabling use of barrier materials for designing package in order to form the protrusion during its holding as well as the defined opening therethrough leaks a substance injected therein. In this manner material can be stored under the pressure. In the package itself can be placed sponge-like material intended for controlling amount of expelled substance during its use.

U.S. Pat. No. 4,489,112 issued to Wise et al, appears to disclose a heat sealable container for edible oils and other types of oils, as well as a procedure for production thereof, which has laminated wall construction of the suitable oil resistant barriers or layers, which are compatible with one another insofar as bonding and sealing are concerned. Such wall construction includes central layers made of aluminum foil and fluorochemically treated paperboard secured to one another by suitable adhesive, an ionomer layer, such as Surlyn, formed on each outer paperboard and foil surface, and a layer of thermoplastic material, such as polyethylene, formed on each outer Surlyn surface. As an alternative for certain applications, the Surlyn layer can be omitted, so the outer layer of thermoplastic material can be applied directly onto the film surface.

U.S. Pat. No. 5,156,330 issued to Rosen appears to disclose an invention relating both to a packaging container and use of packaging material for production thereof. The packaging container contains an skeletal layer made of plastics and filler mixed into the plastics in a quantity between 50% and 80% of total weight of the skeletal layer.

In order to facilitate the opening of the container it is provided with a tearing mark incorporated in the packaging material. Material of the packaging container is torn off along this mark in order to expose a container opening through which the contents of the container are made accesible. The tearing mark according to the invention has an unbroken cut in the skeletal layer or a similar linear recess weakening the packaging material with a depth of penetration of only about 10-30% of the total thickness of the skeletal layer. The recess reduces the inherent tear resistance of the skeletal layer by 60-80%.

SUMMARY OF THE DISCLOSURE

The present disclosure relates to a box made of the cardboard coated with a protective layer, which makes the self folding box acceptable for direct contact with food from the standpoint of health and microbiogical safety. For example, the cardboard can be coated with PET films or foil having thickness of 12-120 microns on the internal side. The cardboard coated with polypropylene film is used for requirements of users who warm packaged foodstuffs up in microwave ovens.

Due to its shape and strength the box 1 enables packaging and heating food up to 15 min at 140° C. The box 1 is impermeable, without any glued element, thus being safe against leakage of semi-liquid food. The boxes having glued corners, edges or bottoms are prone to leaking due to weakening of the joint caused by inadequate gluing or damaging during transportation or forming packages and therefor they haven't been used for packaging of semi-liquid food.

A criterion for choosing the material have been the selection of cardboard enabling branding by printing thereon, as well as its forming and consistence. The box 1 (FIG. 1) is made in such way that it maintains its technical characteristics by using cardboard having grammage between 200-400 g/m$^2$, intended for packaging of foodstuffs having volume up to 0.71 and weight up to 0.5 kg. The external side of the cardboard thereof the box is made can be either coated with the layer providing better printing quality or not coated depending on requirements for printing on the cardboard.

Interestingly, in the present disclosure, a combined self folding, impermeable box for packaging foodstuffs is formed very fast by means of the appropriate tool in the first phase. The tool is made of stainless steel, wherein a bottom and eight tin guides are formed by bending an unfolded blank for the tool. The bottom of the tool has width and length slightly bigger than the box bottom. Eight guides, which are slightly smaller than the lateral sides of the box, have one of the halves thereof resting on the bottom of the tool at an angle of 90 degrees and another of the halves thereof folded outwards at an angle of 30 degrees in relation to the surface of the bottom of the tool and they serve for forming the box. In this case, in the first phase, the unfolded box bottom is positioned above the tool, then it is pressed downwards, so its entering the tool template causes the corner sides folding around the folding lines, while the lateral sides straighten up. In this phase the box obtains the prism shape having the eight-sided base with the corner sides folded on half and directed outwards. The bases of the corner sides are partially made of PET film or foil, while the corner sides have triangular shape and they are bordered with cardboard coated with PET film or foil on the upper side. This is realised in such way that on a cutting machine are first cut out openings in the corner sides of the unfolded blank for the box, then the whole surface is coated with PET film or foil, thereafter the shape of unfolded blank for the box is cut out once more on the cutting machine and finally the folding lines are stamped. In such way is accomplished that the corner sides are partially made of PET film or foil, which can also be transparent providing an effect of window and it is also enabled that the corner sides fold easier in the tool without any loss of shape. In the first phase of insertion of the unfolded blank for the bottom in the tool, the lateral sides are set in upward position, while the corner sides are pulled by means of the guides. The joints of the corner and lateral sides approach one another due to the mentioned pulling, while the corner sides fold around the folding lines and they are directed towards the outside of the bottom of the box. Due to folding of cardboard which borders the corner sides, PET film or foil folds itself, while the cardboard forms the folded corner sides. Cardboard folding causes both streching of cardboard fibers on outer side of the folding line and compression of fibers on internal side of the cardboard. This streching causes deformation of cardboard fibres and determines the folding direction of the corner sides during the following bottom forming, when it is inserted in the tool. In the second phase, when unfolded bottom of the box is turned in such way that its second side enters the tool, the corner sides are formed in such way that they are directed towards the inside of the bottom.

The box formed in such way can be easily filled up and covered with the cover.

The cover prevents opening the box by locking. Stretching and compression of cardboard fibres on the folding lines cause deformation which prevents complete unfolding of the box during its opening, but instead the bottom of the box forms the shape of a shallow tray. The box cover as a separate element is given with its unfolded blank.

It is also interesting that, in the present disclosure, the manual formation of the box becomes faster and in that the corner sides (gussets) are made with cardboard from the upper side and an opening covered with PET film or foil are designed to enable simple formation of the box during insertion into the tool. No additional auxiliary elements are needed for locking the box from its outside and it is also advantageous that the end user can consume foodstuffs from the formed shallow tray and thereafter he can convert the box back into position intended for locking the box with the cover.

The above mentioned aesthetic moment, originating from the openings on the corner sides coated with transparent PET film or foil as well as a window on the box cover provides a very nice visual appearance.

It is also interesting that the box is formed very fast by means of the tool, and since the opened box has a form of shallow tray and the inside of the box is coated with PET material and that is formed without gluing, thus preventing leakage on joints thereof.

Such self folding box with the tool for forming is transported and stored in sheets of cardboard. This enables decrease in transportation and storage expenditures and the tool for forming the box provides for fast and easy forming the box.

BRIEF DESCRIPTION OF DRAWINGS

The disclosure will be described in detail with a reference to a preferred embodiment of the invention and it is illustrated in the drawings, wherein.

DETAILED DESCRIPTION OF THE DISCLOSURE

Figure 1:
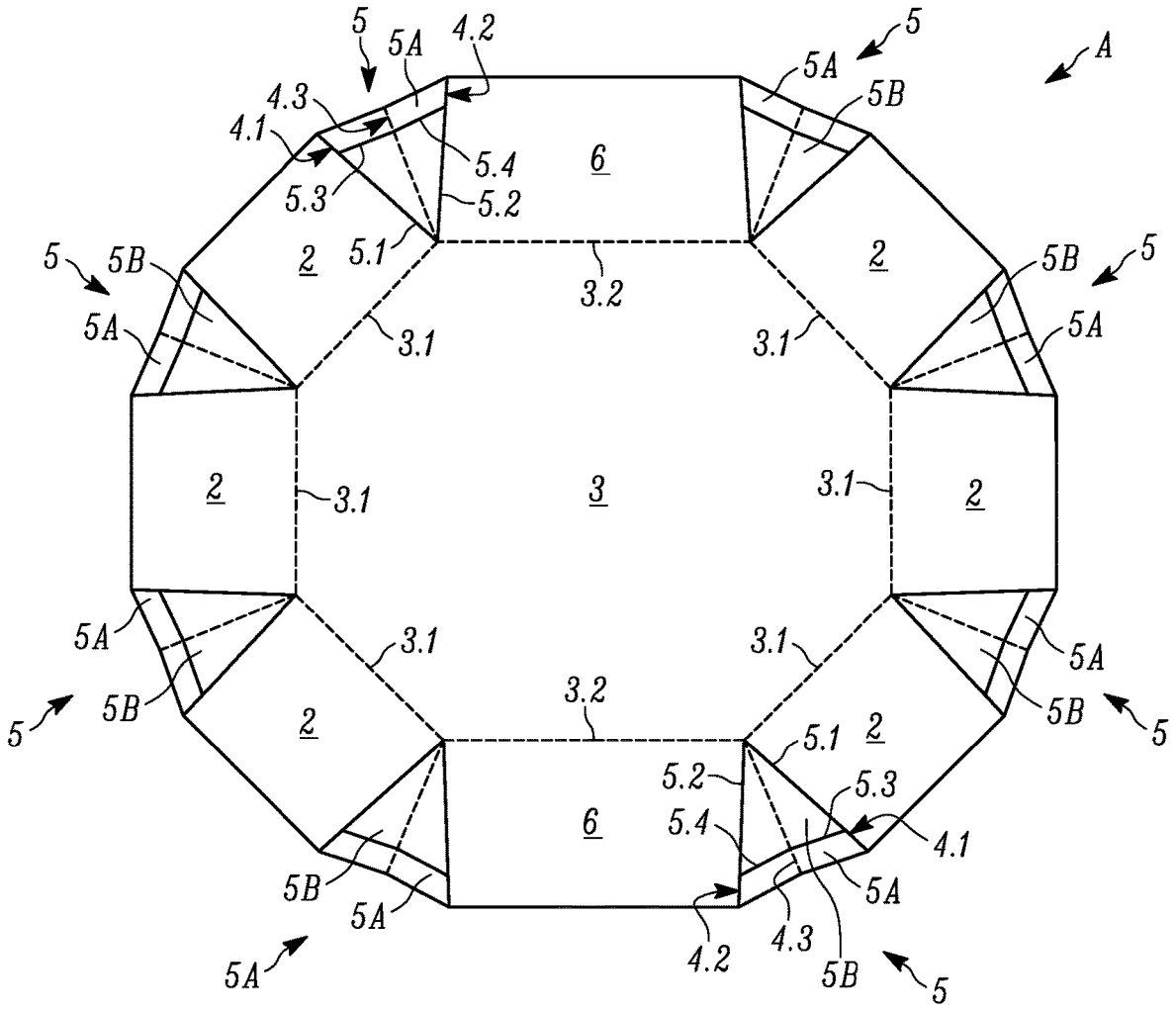
FIG. 1 shows an unfolded blank for the eight-sided food box without the cover.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

Prepared cardboard is cut in a machine therein a tool with knives was placed (not shown), wherein openings in the corner sides (gussets) and in the cover are cut out. The tool is provided with the knives for cutting out and making slits within the formed unfolded blank A (FIG. 1) for the box 1 in such way that previously planned cutting lines 5.1, 5.2, 5.3, 5.4 are made in the cardboard for the each corner side 5 (On FIG. 1 in order to simplify the drawing, marked are cutting and folding lines on only two opposite corner sides 5). Then the whole surface of the cardboard along with the openings 5B is coated with PET film or foil on the inner side, i.e. it is coated in such way that during the box forming the film remains on the inner side. After completion the of lamination process, sheets are inserted in the machine where the tool with knives and folding lines was placed (not shown). In the tool there are knives for cutting off along the contours of the formed unfolded blank A (FIG. 1) for the box 1, as well as internal knives which partially enter into the cardboard in order to make previously planned folding lines 3.1, 3.2, 4.1, 4.2, 4.3 in the cardboard.

Figure 2:
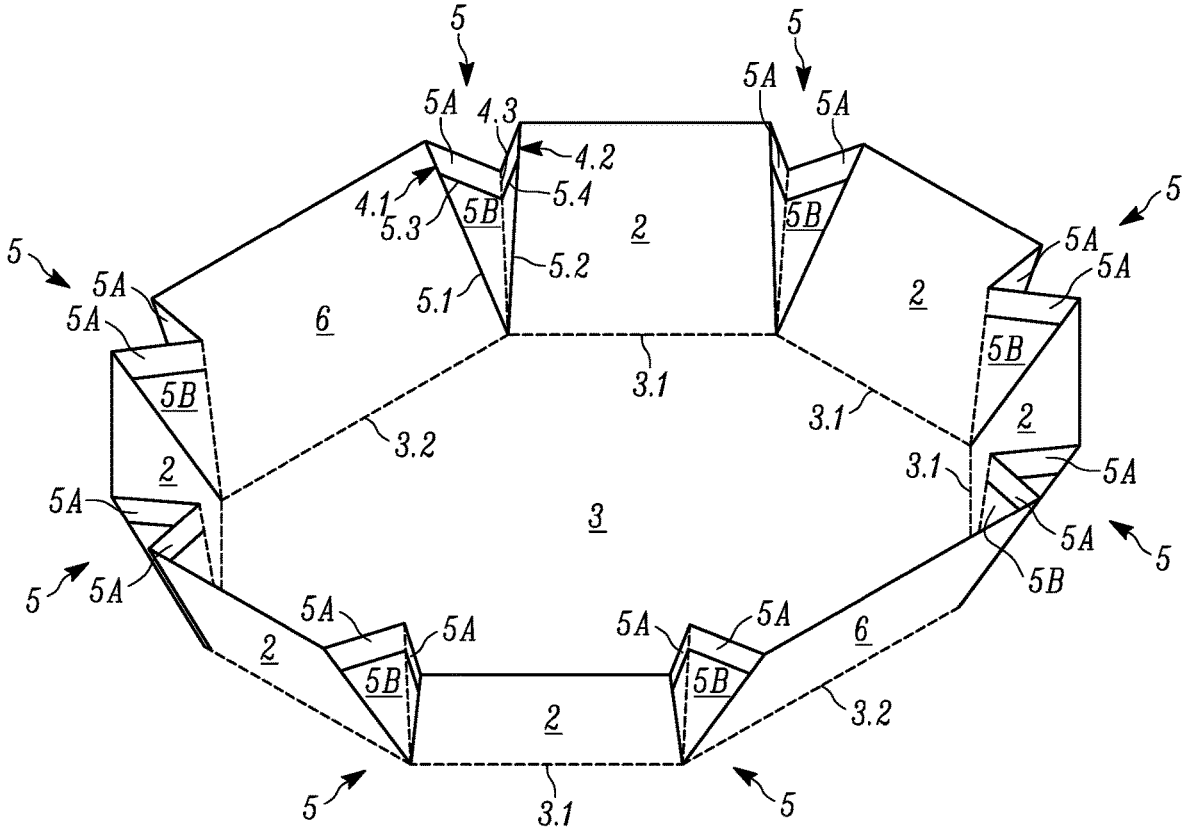
FIG. 2 shows a perspective view of a self folding eight-sided food box without cover.
Figure 3:
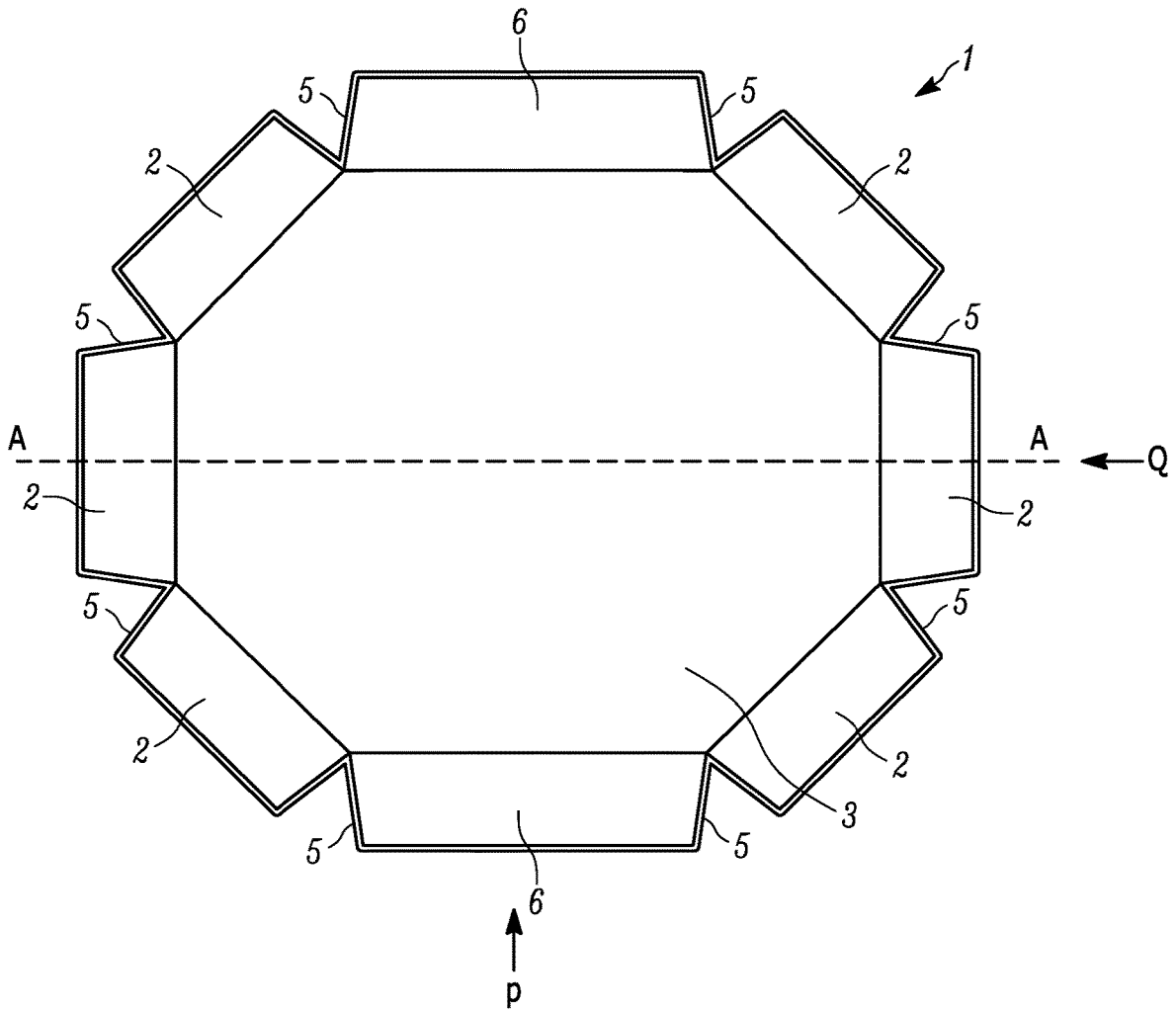
FIG. 3 shows the eight-sided impermeable food box, an upper view from a vantage O of FIG. 4.
Figure 4:
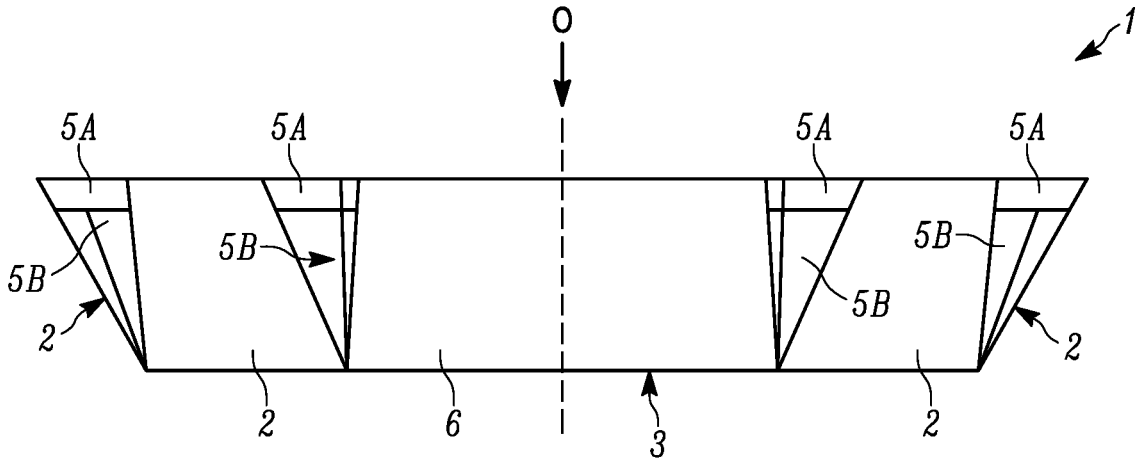
FIG. 4 shows a section taken generally about line A-A of FIG. 3.
Figure 5:
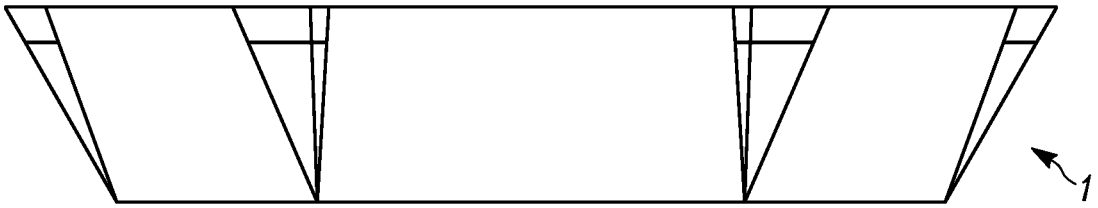
FIG. 5 shows a side elevational view taken generally from a vantage P shown on FIG. 3.
Figure 6:
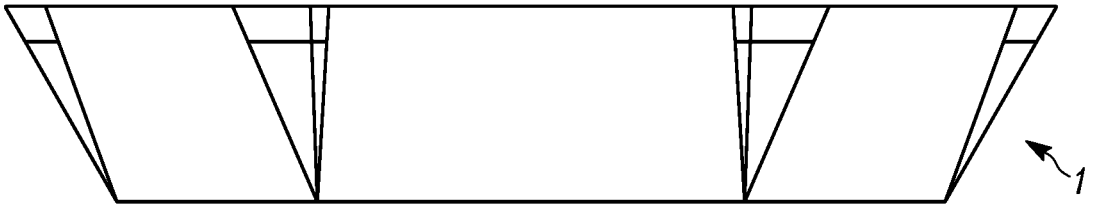
FIG. 6 shows a side elevational view taken generally from a vantage Q shown on FIG. 3.
Figure 9:
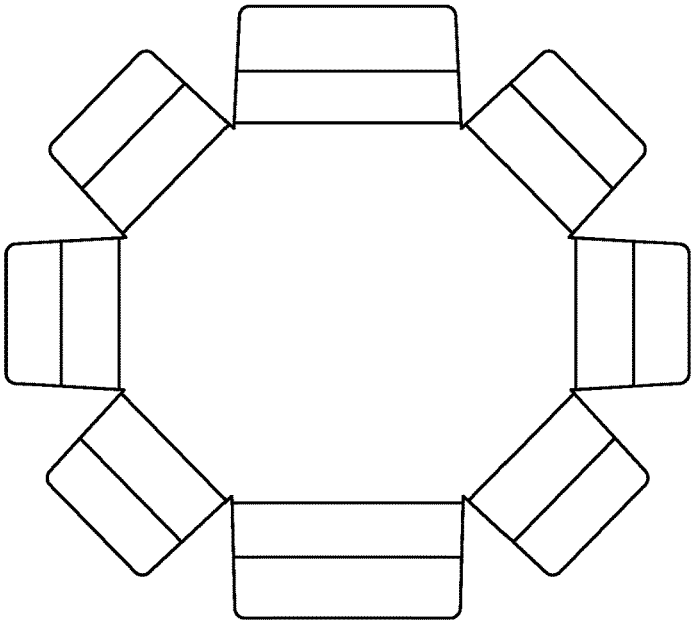
FIG. 9 shows an unfolded tool for forming the eight-sided box.
Figure 10:
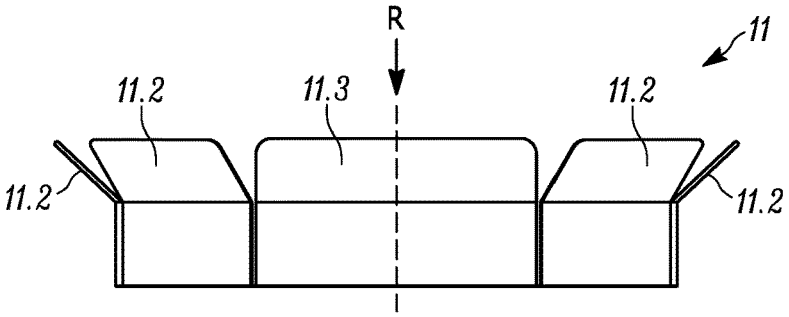
FIG. 10 shows the tool for forming the eight-sided food box.
Figure 11:
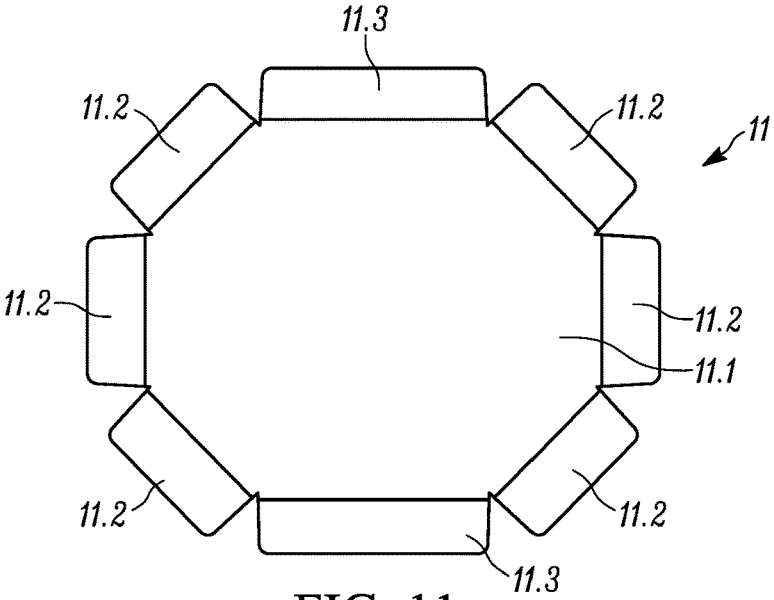
FIG. 11 shows a top plan view from a vantage R of FIG. 10.
Figure 12:
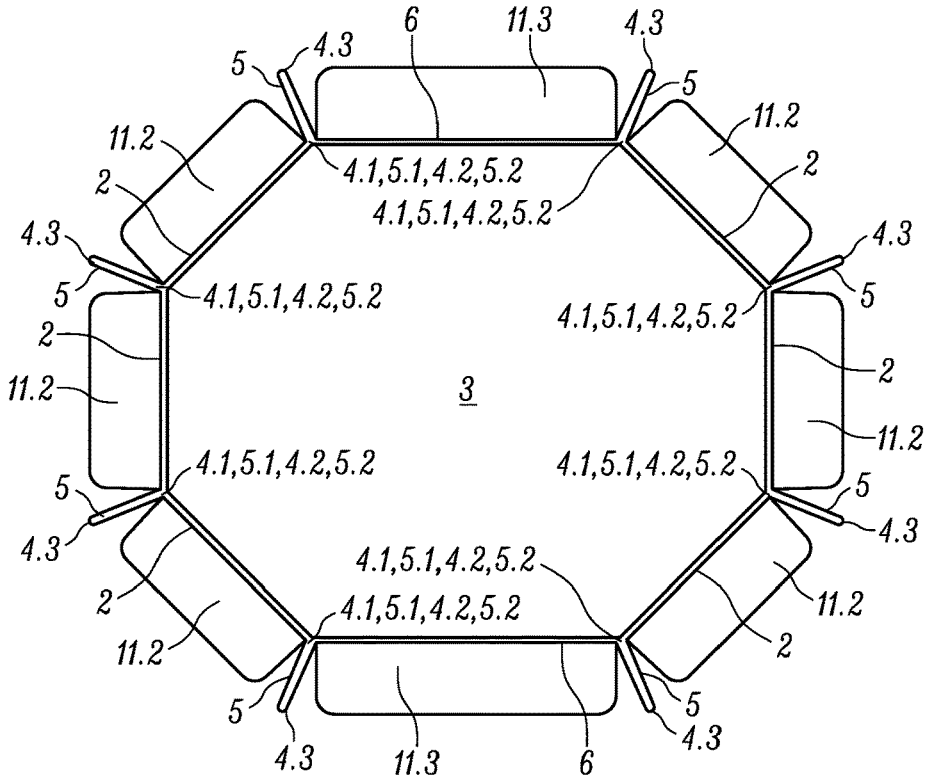
FIG. 12 shows the first phase of folding the box in the tool for forming the box.
Figure 13:
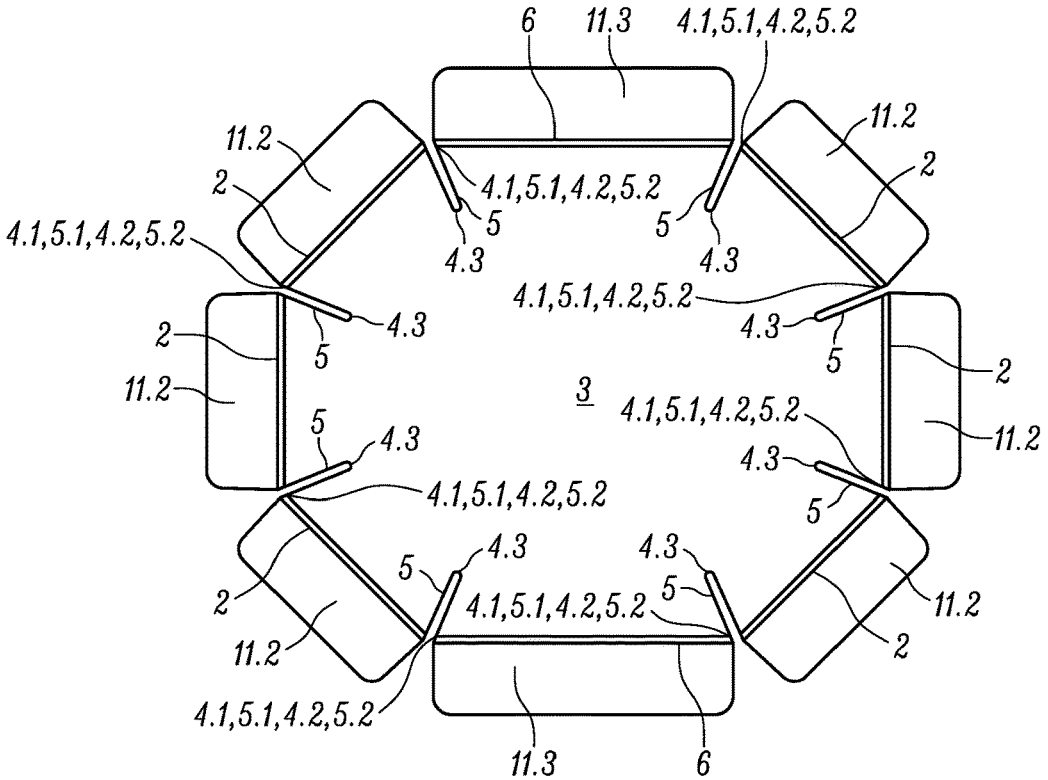
FIG. 13 shows the second phase of folding the box in the tool for forming the box.

The box 1 (FIG. 1 and FIG. 2) is formed in the tool 11 (FIG. 9, FIG. 10 and FIG. 11). The formed unfolded blank A is positioned above the tool 11 on the slant guides 11.2, 11.3 and thereafter a part of the formed unfolded blank A for the bottom 3 is pressed by hand until the bottom 3 rests on the bottom 11.1 of the tool between the slant guides 11.2, 11.3. At the same time the sides 2 and the sides 6 of the formed unfolded blank A rest on the slant guides 11.2, 11.3, while the corner sides 5, which are bordered with cardboard 5A, bend around the folding lines 4.3, as shown in FIG. 12. Then the outer folding lines 4.1 and 4.2, and punched lines 5.1 and 5.2 of the corner side 5 coincide in such way to form the corner line of two mutually connected lateral sides 2, 6 of the box 1. In this manner is performed deformation of fibres of the cardboard bordering the corner sides around folding lines 4.3 and the box is formed having the bottom 3 and six lateral sides 2 and two lateral sides 6 as well as eight folded corner sides 5 on the corners of the lateral sides 2,6 which are directed outwards. The formed unfolded blank A for the box is than taken out of the tool, turned upside down around 180 degrees in such way that the second side is positioned above the tool 11 on the slant guides 11.2, 11.3 and a part of the unfolded blank A is pressed by hand on its bottom 3 until the bottom 3 rests on the bottom 11.1 of the tool between the slant guides 11.2, 11.3. At the same time the lateral sides 2 and the lateral sides 6 of the unfolded blank A rest on the slant guides 11.2, 11.3, while the corner sides 5 bordered with cardboard 5A fold around the folding lines 4.3, as shown in FIG. 13. Then the outer folding lines 4.1, 5.1 and 4.2, 5.2 of the corner sides 5 coincide in such way to form the corner line of two mutually connected lateral sides 2, and respectively lateral sides 6 of the box 1. In this manner is formed the box with the bottom 3 and six lateral sides 2 and two lateral sides 6, as well as eight folded corner sides 5 on the corners of the lateral sides 2, 6 directed towards the inside of the bottom 3 of the box 1.

Figure 7:
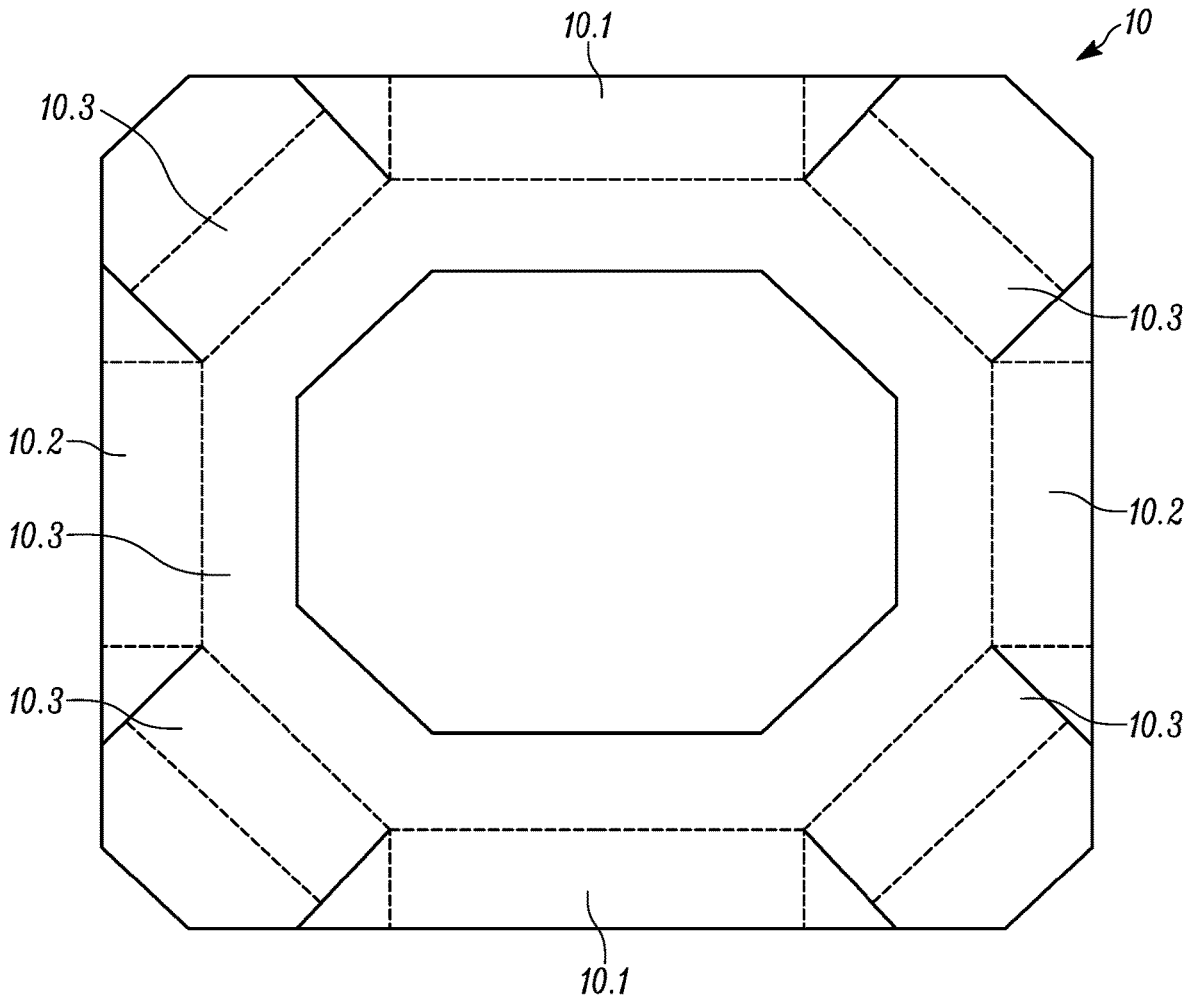
FIG. 7 shows an unfolded blank for the cover of the eight-sided box.
Figure 8:
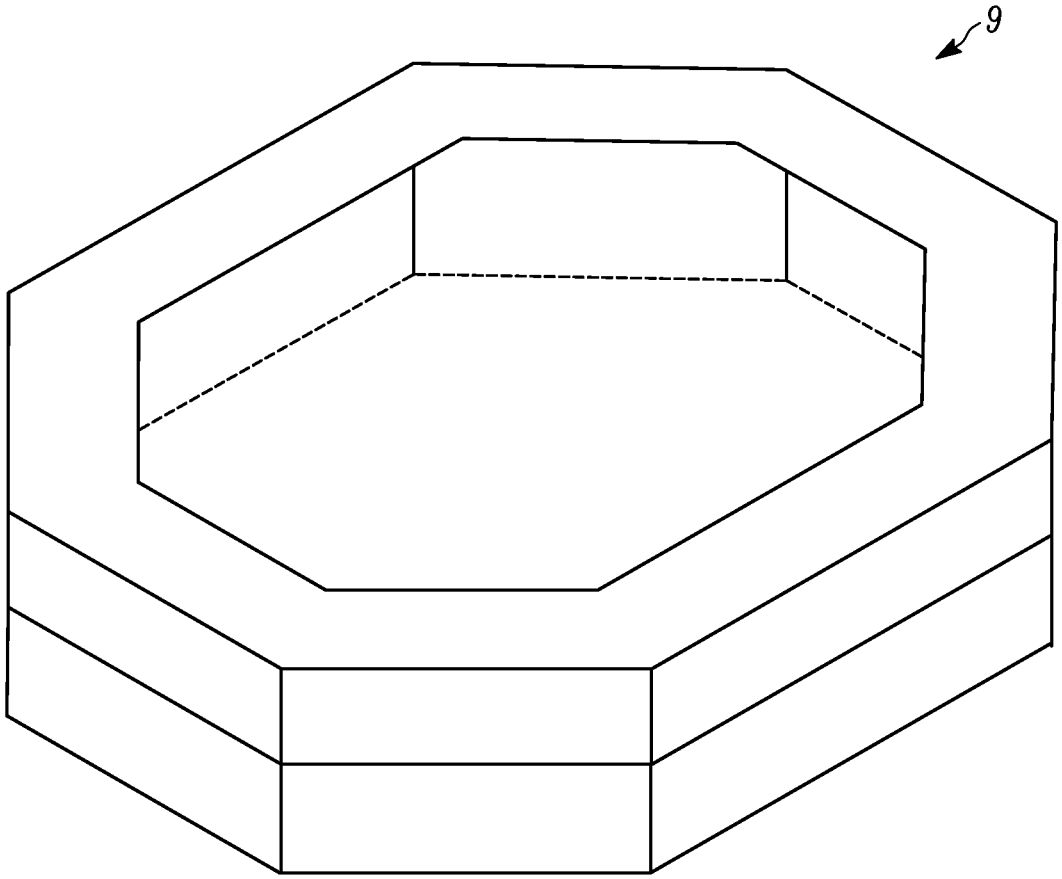
FIG. 8 shows a perspective view of the self folding eight-sided impermeable food box with the cover.

The box 1 is covered with a cover 10, whose unfolded blank is shown in FIG. 7. A central part 10.3 of the cover includes transparent PET film or foil bordered with cardboard. Parts on the unfolded blank 10, which are designated with 10.1, 10.2, 10.3, form the lateral sides of the cover. (The figure shows designation of full lines for the cutting lines and a dashed lines for the folding lines) A perspective view of the box 1 with the cover 10 is shown in FIG. 8.

Figure 14:
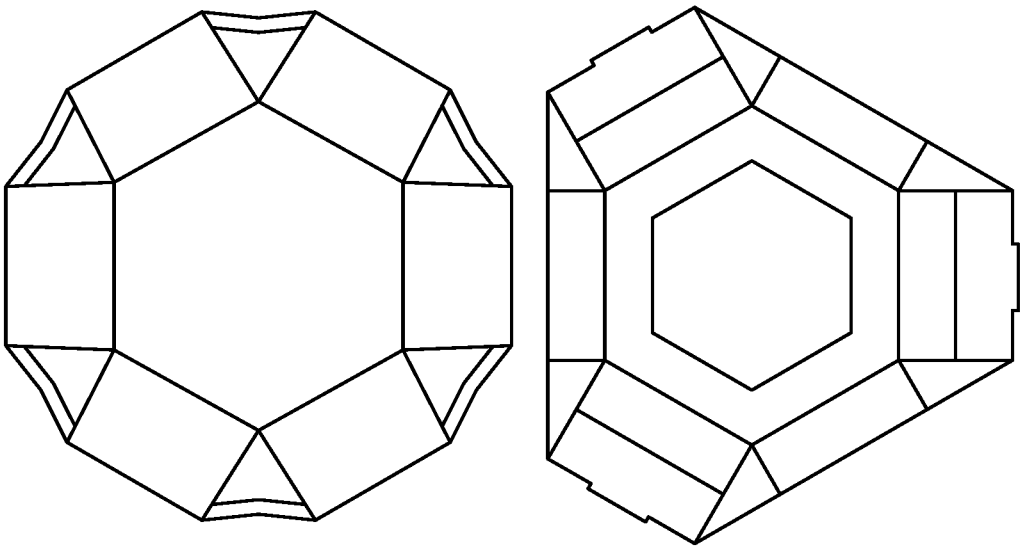
FIG. 14 shows a second embodiment, namely, variant I, of the unfolded six-sided box, its base and cover.

It is also envisaged another variant of embodiment of the box. The variant I (FIG. 14) comprises the box having a bottom with six-sided base, and on the drawing may be seen unfolded blanks of the six sided box and the unfolded blank of the cover.

Forming the box 1 is performed in the tool 11 for forming in the same manner as described in the previous part and shown in FIGS. 12 and 13. The tool is made of stainless steel, wherein a unfolded blank for the tool is shown in FIG. 9 and the bottom 11.1 and the eight guides 11.2, 11.3 are formed by means of bending. The first half of the each guide rests on the bottom at an angle of 90 degrees, while the second half is bended outwards, thereby forms an angle of 30 degrees with a plane of the bottom and it intended for forming the form of the box. The slant guides 11.2 correspond to the bending angle of the lateral sides 2, while the guides 11.3 correspond to the bending angle of the lateral sides 6. Corners between the slant guides 11.2, 11.3 represent a space where are formed the folded corner sides 5.

In the box 1 are poured edible ready-to-eat meals, salads, fried and fatty products.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A self folding polygonal impermeable food box, comprising:

a polygonal cover of the self folding polygonal impermeable food box; and a polygonal bottom, of the self folding polygonal impermeable food box, including lateral sides, corner sides, and a polygonal bottom, the polygonal bottom being attached to the lateral sides, each of the lateral sides being adjacent to one side of the polygonal bottom, the corner sides being located at each corner of the polygonal bottom, with folding lines that engage each side of the polygonal bottom with one lateral side, each of the lateral sides being engaged with two adjacent corner sides, with said polygonal bottom, the lateral sides, and the corner sides being made of cardboard covered by a Polyethylene Terephthalate (PET) layer;

wherein the corner sides of the polygonal bottom have a triangular shape and are comprised of triangular cut out openings in the cardboard which extend from the corner sides of the polygonal bottom and along edges of adjacent lateral sides and include the PET layer and one side of the triangular corner side which is not adjacent to the corner of the polygonal bottom comprises cardboard covered by the PET layer.

2. The self folding impermeable food box according to claim 1, wherein the number of corners of the bottom, lateral sides and corner sides is equal to one of 6 and 8.

3. The self folding impermeable food box in accordance with claim 1, wherein the self folding impermeable food box maintains a shape of a shallow tray after being opened.

4. The self folding impermeable food box in accordance with claim 1, wherein the polygonal cover comprises a central part made from at least one of transparent PET film and foil bordered with the cardboard.

5. The self folding impermeable food box in accordance with claim 1, wherein the self folding impermeable food box is made by folding a formed unfolded blank around the folding lines.

* * * * *